United States Patent [19]

Kobayashi et al.

[11] 4,273,845

[45] Jun. 16, 1981

[54] HEAT-DEVELOPABLE PHOTOSENSITIVE MATERIAL

[75] Inventors: Hajime Kobayashi, Mitaka; Yasuhiro Yano, Tokyo; Ichiro Endo, Yokohama, all of Japan

[73] Assignee: Canon Kabushiki Kaisha, Tokyo, Japan

[21] Appl. No.: 125,672

[22] Filed: Feb. 28, 1980

Related U.S. Application Data

[63] Continuation of Ser. No. 761,368, Jan. 21, 1977, abandoned.

[30] Foreign Application Priority Data

| | | | |
|---|---|---|---|
| Jan. 23, 1976 | [JP] | Japan | 51/6497 |
| Jan. 26, 1976 | [JP] | Japan | 51/7731 |
| Jan. 26, 1976 | [JP] | Japan | 51/7732 |
| Jan. 26, 1976 | [JP] | Japan | 51/7734 |

[51] Int. Cl.[3] ..... G03G 13/14

[52] U.S. Cl. ..... 430/48; 430/49; 430/126; 430/353; 430/620; 101/467; 101/DIG. 13

[58] Field of Search ..... 430/48, 49, 54, 126, 430/353, 620, 31; 101/467, DIG. 13

[56] References Cited

U.S. PATENT DOCUMENTS

| | | | |
|---|---|---|---|
| 2,317,521 | 4/1943 | Crowley et al. | 430/540 |
| 2,361,665 | 10/1944 | Toland et al. | 430/302 |
| 3,811,885 | 5/1974 | Marchant et al. | 430/346 |
| 3,846,136 | 11/1974 | Sullivan | 430/617 |
| 3,852,067 | 12/1974 | Levy | 430/93 |
| 3,957,493 | 5/1976 | Masuda et al. | 430/619 |
| 3,991,256 | 11/1976 | Cornier et al. | 430/62 |
| 3,998,634 | 12/1976 | Iwasa | 430/57 |
| 4,009,039 | 2/1977 | Masuda et al. | 430/619 |
| 4,057,016 | 11/1977 | Endo et al. | 430/49 |
| 4,069,759 | 1/1978 | Endo et al. | 430/126 |
| 4,106,409 | 8/1978 | Kobayashi et al. | 430/48 |

OTHER PUBLICATIONS

Bennett, Concise Chemical and Technical Dictionary, CRC, New York, 1974.

*Primary Examiner*—Travis Brown

*Attorney, Agent, or Firm*—Fitzpatrick, Cella, Harper & Scinto

[57] ABSTRACT

A heat-developable photosensitive material for producing an electrostatic printing master having improved electrostatic characteristics comprises a support, an organic silver salt, a reducing agent, and a binder.

2 Claims, No Drawings

HEAT-DEVELOPABLE PHOTOSENSITIVE MATERIAL

This is a continuation, of application Ser. No. 761,368, filed Jan. 21, 1977, abandoned.

This application is related to commonly assigned application Ser. No. 825,043, filed Aug. 16, 1977, abandoned, Ser. No. 932,282 filed Aug. 9, 1978 and Ser. No. 948,238 filed Oct. 3, 1978, now U.S. Pat. No. 4,237,213.

BACKGROUND OF THE INVENTION a. Field of the Invention

This invention relates to a heat-developable photosensitive material for an electrostatic printing master, and more particularly, to an improved heat-developable photosensitive material for an electrostatic printing master containing an organic silver salt.

b. Description of the Prior Art

Many printing methods are known. Among them, electrostatic printing methods belong to a special class. The principle of ordinary printing is based on selectively attaching an ink to the surface of a printing master in accordance as a result of an uneven surface on the printing master or as a result of difference of solvent affinity, and then pressing the attached ink to a paper. On the other hand, in the electrostatic printing the ink is replaced by a heat-fixable toner which is electrostatically attached to a printing master and then transferred and fixed to an image-receiving sheet e.g. of paper. Ordinary printing has the advantage that the ink is attached uniformly and firmly to the printing master so that many sheets of paper can be printed at a high speed, but the ink can disadvantageously become attached to portions other than those to be printed. On the other hand, in electrostatic printing methods the toner can become attached electrostatically so that firmness and uniformity of adhesion are heartily dependent upon electrostatic "contrast" which is difficult to achieve so that known methods are not suitable for a high speed printing although dirtying as mentioned above is not such a problem as in ordinary printing. In view of the disadvantages, electrostatic printing has not been practically used as a clean printing method. In other words, electrostatic printing is poorer than conventional printing methods as to providing many sheets of print and uniformly clear print. For example, representative known electrostatic printing masters are a master composed of a conductive support and an insulating image overlying the conductive support and a master composed of an insulating support and a conductive image overlying on the insulating support. The image may be produced by attaching an insulating or a conductive lacquer in a form of the image pattern to the support, or by coating a photosensitive lacquer on a support, imagewise exposing and selectively removing the exposed or unexposed portions by etching. Such electrostatic printing masters have various drawbacks. The sharpness of the print and the durability of the electrostatic printing master are usually poor, e.g. when used in the master is used in a conventional electrostatic printing process. Such a process can include a charging step for forming the electrostatic images by selectively retaining electric charge at image portions (the image portions are insulating), a developing step in which a toner charged with a polarity opposite to that of image portions is applied and a transfer step in which the toner image is transferred to a receiving sheet. For example, the known electrostatic printing master has images formed by unevenness on the surface and the uneven surface is damaged by mechanical abrasion during the printing process to cause irregular charging so that durability of the master is very low. Furthermore it is very difficult to obtain a high resolving power with such an uneven master and thereby it is also difficult technically to obtain a print having high resolution. Furthermore, it is difficult to obtain images of half tone or gradation with such uneven surface type master.

In U.S. Ser. No. 599,061 filed July 25, 1975 there is disclosed a new electrostatic printing master free from the drawbacks of known electrostatic printing masters. The electrostatic printing master has a layer containing silver images carried in an electrically insulating medium having an electric resistance sufficient to retain electrostatic charge and the surface is smooth because there is not any relief patterns corresponding to the images. Therefore, upon printing the images are hardly damaged by mechanical abrasion and have excellent durability, and further the resolution of the silver image itself is high; the resolution is excellent due to a continuous gradation; optical density can be changed in accordance with an optional continuous gradation; and further there are such advantages as very helpful in the fields of printing and high speed copying of many copies. In general, the above-mentioned electrostatic printing master having a layer containing silver images can be obtained by imagewise exposing a silver salt photosensitive material and developing. And the silver images can be formed by a dry treatment so that the photosensitive material containing an organic silver salt is very effective from a point of view of simplicity of image formation.

Such photosensitive materials are usually called "heat-developable photosensitive material". Known heat-developable photosensitive materials are, for example, those as disclosed in U.S. Pat. Nos. 3,457,075; 3,531,286; and 3,589,903.

However, those heat-developable photosensitive materials are for direct copying purpose, that is, the visible images formed on said materials are used for the final purpose. Therefore, those materials can give excellent visible images, but do not have all characteristics necessary for an electrostatic printing master. Thus, those known materials are not satisfactory to producing electrostatic printing masters from a practical point of view.

Printing processes using electrostatic printing master are carried out by, for example, charging the master with a corona discharger to convert the electric resistance patterns to electrostatic charge patterns, developing the electrostatic charge patterns with toner particles to produce toner images and transferring the toner images thus formed to an image-receiving member such as paper.

Therefore, the electrostatic printing master should have the following characteristics, that is, high acceptance potential at portions where electrostatic charge is charged (portions of relatively high electric resistance), good electrostatic charge retentivity, low background potential, high electrostatic potential contrast, high mechanical, electrostatic, repeating durability, excellent property of development, good cleaning property, high sharpness of the final image formed on an image-receiving member, excellent electrical fatigue resistance, sufficient mechanical strength and the like. In addition, it is desirable for the electrostatic printing master to have the following characteristics: simple, rapid and easy production of the electrostatic printing master, simple production of the heat-developable photosensitive material itself, low cost, easy transportation and convenient distribution and the like.

SUMMARY OF THE INVENTION

An object of the present invention is to provide a heat-developable photosensitive material for an electrostatic printing master satisfying the above mentioned requirements and having high commercial value and excellent characteristics.

Another object of the present invention is to provide a heat-developable photosensitive material having a high acceptance potential at portions which is electrostatically charged (portions of a relatively high resistance) and excellent electrostatic charge retentivity.

Further object of the present invention is to provide a heat-developable photosensitive material capable of giving an electrostatic printing master having mechanical, electrostatic, repeating durability.

Still another object of the present invention is to provide a heat-developable photosensitive material capable of giving an electrostatic printing master having very low background potential and giving a practically sufficient electrostatic potential contrast.

According to the present invention, there is provided a heat-developable photosensitive material for producing an electrostatic printing master having improved electrostatic characteristics which comprises a support,
(a) an organic silver salt,
(b) an orgaic acid,
(c) a halide,
(d) a reducing agent,
and
(e) a binder,
at least the organic silver salt (a) and the organic acid (b) being dispersed in the binder (e), the amount of the organic silver salt (a) being at least 10 molar percent based on the sum of the organic silver salt (a) and the organic acid (b), and the amount of the binder (e) being 0.02–20 parts by weight based on one part of the organic silver salt (a).

According to another aspect of the present invention, there is provided a heat-developable photosensitive material for an electrostatic printing master which comprises a support,
(a) an organic silver salt,
(c) a halide,
(d) a reducing agent,
(e) a binder of a dielectric breakdown strength of at least 10 KV/mm, and
(f) a heavy metal compound, and the organic silver salt (a) being dispersed in the binder (e) of 0.02–20 parts by weight per one part by weight of the organic silver salt (a).

According to further aspect of the present invention, there is provided a heat-developable photosensitive material for an electrostatic printing master which comprises a support,
(a) an organic silver salt,
(c) a halide,
(d) a reducing agent,
and
(e) a binder having an equilibrium moisture content of not more than 3.0% at a relative humidity ranging from 20 to 100%, and the organic silver salt (a) being dispersed in the binder
(e) of 0.02–20 parts by weight per one part by weight of the organic silver salt.

According to still another aspect of the present invention, there is provided a heat-developable photosensitive material for an electrostatic printing master which comprises a support,
(a) an organic silver salt,
(d) a reducing agent, and
(e) a binder having a dielectric breakdown strength of at least 10 KV/mm and an equilibrium moisture content of not more than 3.0 % at a relative humidity ranging from 20 to 100%, the organic silver salt (a) being dispersed in the binder (e) of 0.02–20 parts by weight per one part of the organic silver salt (a).

According to still further aspect of the present invention, there is provided a heat-developable photosensitive material for producing an electrostatic printing master having improved electrostatic characteristics which comprises a support,
(a) an organic silver salt,
(b) an organic acid,
(c) a halide of not more than 1 mole per 1 mole of the organic silver salt (a),
(d) an organic reducing agent of not more than 5 moles per one mole of the organic silver salt (a),
(e) an electrically insulating resinous binder having a dielectric breakdown strength of at least 10 KV/mm and an equilibrium moisture content of not more than 3.0% at a relative humidity ranging from 20 to 100%, and
(f) a heavy metal compound of $1-10^{-7}$ mole per one mole of the organic silver salt (a), the organic silver salt (a) and the organic acid (b) being dispersed in the electrically insulating resinous binder (e), and the amount of the organic silver salt (a) being not more than 10 molar percent based on the sum of the organic silver salt (a) and the organic acid (b).

DESCRIPTION OF THE PREFERRED EMBODIMENTS

The present invention is based upon the discovery that there is an organic relation among the mode of existence of the organic silver salt in the binder, the amount relation between the organic silver salt and the binder, type of the binder, and further the method of preparation, and in addition, a discovery that the above-mentioned objects can be achieved when such organic relation satisfies particular conditions.

Structure of the heat-developable photosensitive material for an electrostatic printing master is usually that the organic silver salt layer overlies the support. The organic silver salt layer is usually a layer composed of the organic silver salt (a) as a main ingredient dispersed in an electrically insulating medium.

The organic silver salt is a main source supplying metallic silver for forming silver images of the electrostatic printing master. The electrically insulating medium is selected from electrically insulating binder materials, has film-shapability for forming the organic silver salt layer, and serves as a dispersion medium for dispersing the organic silver salt and other ingredients uniformly in the organic silver salt layer. Furthermore, the electrically insulating medium imparts an electrostatic charge retentivity to the non-silver image portions of the electrostatic printing master so that electrostatic latent images having electrostatic potential contrast sufficiently high for practical purposes can be produced when the electrostatic printing master having silver images are charged.

In addition to the organic silver salt, there may be incorporated a halide, a reducing agent and others to the organic silver salt so as to achieve the above-mentioned objects.

The halide is added so as to impart photosensitivity to the heat-developable photosensitive material and the reducing agent is added for the purpose of reducing the organic silver salt to isolate metallic silver when heat-development is carried out for producing the electrostatic printing master.

The reducing agent may be directly dispersed in the organic silver salt layer, and alternatively, the reducing agent may be applied in a form of a layer, for example, by mixing the reducing agent with a film-shapable resinous binder such as cellulose acetate in an appropriate solvent and applying the resulting mixture to a surface of the organic silver salt layer to form a reducing agent layer.

However, in case of producing the reducing agent layer on an organic silver salt layer, it is desirable that a sufficiently thin reducing agent layer is formed, or the film-shapable binder for the reducing agent layer is made of a material which can not or hardly retain electrostatic charge because the surface of the reducing agent layer is uniformly charged and thereby electrostatic latent images are hardly produced if the electrostatic charge retentivity of the binder is large.

Representative organic silver salts used in the present invention are silver salts of organic acids, mercapto compounds and imino compounds and organic silver complex salts. Among them, silver salts of organic acids, in particular, silver salts of fatty acids are preferable.

Typical organic silver salts may be mentioned as shown below.

1. Silver salts of organic acids (1) Silver salts of fatty acids (1) Silver salts of saturated aliphatic carboxylic acids; silver acetate, silver propionate, silver butyrate, silver vulerate, silver caproate, silver enanthate, silver caprylate, silver pelargonate, silver caprate, silver undecylate, silver laurate, silver tridecylate, silver myristate, silver pentadecylate, silver palmitate, silver heptadecylate, silver stearate, silver nonadecylate, silver arachidate, silver behenate, silver lignocerate, silver cerotate, silver heptacosanate, silver montanate, silver melissinate, silver laccerate, and the like.

(2) Silver salts of unsaturated aliphatic carboxylic acids; silver acrylate, silver crotonate, silver 3-hexenate, silver 2-octenate, silver oleate, silver 4-tetradecenate, silver stearolate, silver docosenate, silver behenolate, silver 9-undecynate, silver arachidonate, and the like.

(3) Silver salts of aliphatic dicarboxylic acids: silver oxalate and the like.

(4) Silver salts of hydroxycarboxylic acids: silver hydroxystearate and the like.

(2) Silver salts of aromatic carboxylic acids (1) Silver salts of aromatic carboxylic acids: silver benzoate, silver o-aminobenzoate, silver p-nitrobenzoate, silver phenylbenzoate, silver acetoamidobenzoate, silver salicylate, silver picolinate, silver 4-n-octadecyloxydiphenyl-4-carboxylate and the like.

(2) Silver salts of aromatic dicarboxylic acids; silver phthalate, silver quinolinate and the like.

(3) Silver salts of thiocarboxylic acids silver, $\alpha,\alpha'$-dithiodipropionate, silver $\beta,\beta'$-dithiodipropionate, silver thiobenzoate and the like.

(4) Silver salts of sulfonic acids silver p-toluenesulfonate, silver dodecylbenzenesulfonate, silver taurinate and the like.

(5) Silver sulfinates silver p-acetoaminobenzenesulfinate and the like.

(6) Silver carbamates silver diethyldithiocarbamate and the like.

2. Silver salts of mercapto compounds silver 2-mercaptobenzoxazole, silver 2-mercaptobenzothiazole, silver 2-mercaptobenzimidazole, and the like.

3. Silver salts of imino compounds silver 1,2,4-triazole, silver benzimidazole, silver benztriazole, silver 5-nitrobenzimidazole, silver 5-nitrobenztriazole, silver o-sulfobenzimide, and the like.

4. Organic silver complex salts silver di-8-hydroxyquinoline, silver phtharazone, and the like.

The function of the reducing agent in the present invention is described above in detail.

Representative reducing agents are organic reducing agents such as phenols, bisphenols, naphthols, di- or polyhydroxybenzenes and the like.

Typical reducing agents are as shown below.

(1) Phenols:

aminophenol, 2,6-di-t-butyl-p-cresol, p-methylaminophenol sulfate (metol), and the like.

(2) Bisphenols:

2,2'-methylene bis(6-t-butyl-4-methylphenol), 4,4'-butylidene bis(6-t-butyl-3-methylphenol), 4,4'-bis(6-t-butyl-3-methylphenol), 4,4'-thio bis(6-t-butyl-2-methylphenol), 2,2'-methylene bis(6-t-butyl-4-ethylphenol), and the like.

(3) Naphthols:

2,2'-dihydroxy-1,1'-binaphthyl, 6,6'-dibromo-2,2'-dihydroxy-1,1'-binaphthyl, bis(2-hydroxy-1-naphthyl) methane, methylhydroxynaphthalene, and the like.

(4) Di- or polyhydroxybenzenes:

hydroquinone, methylhydroquinone, chlorohydroquinone, bromohydroquinone, pyrogallol, catechol and the like.

(6) Others:

1-phenyl-3-pyrazolidone (phenidone) and the like.

The reducing agents may be used in combination, if desired.

Among the above mentioned reducing agents, phenols, bisphenols are preferable, and bisphenols are more preferable.

The amount of the reducing agent is appropriately determined depending upon the desired characteristics of the heat-developable photosensitive material. Usually it is not more than 5 moles, preferably not more than one mole, more preferably $1-10^{-5}$ mole per mole of the organic silver salt.

As halides used in the present invention, there may be used inorganic halides and halogen-containing organic compounds. In particular, monovalent metal halides, alkaline earth metal halides and ammonium halides are preferable, because such compounds contribute to lower the background potential of the master, to a great extent, according to the experimental results though the mechanism of lowering the background potential is not clear.

Representative halides are as shown below.

(1) Inorganic halides:

Preferable inorganic halides are those having the formula $$MX_m$$

where X is halogen such as Cl, Br and I, and M is hydrogen, ammonium, or metal such as potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanium, iridium, aluminum and the like, and m is 1 when M is halogen or ammonium and a value of valency of a metal when M is the metal.

Further, silver chlorobromide, silver chlorobromoiodide, silver bromoiodide and silver chloroiodide are also preferable.

(2) Halogen-containing organic compounds:

carbon tetrachloride, chloroform, trichloroethylene, triphenyl methyl chloride, triphenyl methyl bromide, iodoform, bromoform, cetylethyl dimethyl ammonium bromide and the like.

The mechanism of function of the halides are not yet clear, but among the above-mentioned halides, the mechanism as to silver halides is considered as follows. Exposure causes formation of isolated silver and the resulting silver functions as developing nucleus upon heat-development and accelerates isolation of silver from the organic silver salt to produce silver images.

With respect to the halides other than silver halides, such halides seem to react with the organic silver salts to produce silver halides and then silver is isolated from the silver halides in a way as mentioned above and works as developing nucleus to produce silver images.

The above mentioned halides may be used alone or in combination.

It is desirable that the amount of the halide is as small as possible, provided that a minimum photosensitivity necessary to form images upon imagewise exposure, in other words, the amount of the halide is a minimum amount enough to produce developing nucleus capable of conducting heat-development.

When the halide is added in an amount over the necessary amount as mentioned above, silver halides which are photosensitive remain in the material and thereby photosensitivity of the material becomes unnecessarily so high that the material should be stored or handled with an extensive care not to expose the material to even a small quantity of light. Otherwise the material is subjected to color change and so-called fog is formed.

On the contrary, when the amount of the halide is less than that necessary, there can not be formed a sufficient amount of developing nucleus for heat-developing efficiently.

Taking such limitations into consideration, the amount of the halide is usually $1-10^{-6}$ mole, preferably $10^{-1}-10^{-6}$ mole, more preferably $10^{-1}-10^{-5}$ mole per one mole of the organic silver salt.

The halide may be incorporated into the organic silver salt layer. Further the halide may be incorporated into the reducing agent layer. Still further, the halide may be incorporated into both the organic silver salt layer and the reducing agent layer. In addition, the halide may overlie the organic silver salt layer in a form of the halide layer or a layer containing the halide. For example, when there is a reducing agent layer, there may be used a laminated structure such as organic silver salt layer-halide layer-reducing agent layer, halide layer-organic silver salt layer-reducing agent layer, reducing agent layer-organic silver salt layer-halide layer, and the like.

When the organic silver salt is present in the organic silver salt layer together with the organic acid, the above mentioned objects are more effectively achieved. The reason why the coexistence of these two compounds in one layer is effective is not yet clear, but it is considered that the mode of existence of the organic silver salt is such that facilitating isolation of metallic silver from the organic silver salt upon producing the electrostatic printing master and further, the organic silver salt in the layer is rearranged due to relaxation of the organic acid caused by the heat action upon heat-development and thereby the metallic silver-isolating reaction is accelerated and the density of the isolated metallic silver is increased.

Various methods may be employed to prepare a binder layer in which both the organic silver salt and the organic acid are dispersed.

For example, the organic silver salt and the organic acid are preliminarily mixed and dispersed in a binder; the organic silver salt, the organic acid and the binder are mixed together; and the organic silver salt is co-precipitated with the organic acid upon producing the organic silver salt and the resulting co-precipitation mixture of the organic silver salt and the organic acid (hereinafter "co-precipitation mixture" means a co-precipitation mixture of the organic acid and the organic silver salt unless otherwise specified) is dispersed in the binder to form a layer. In particular, the method for forming a layer by dispersing the co-precipitation mixture in the binder is preferable. The reason is that when a silver salt of organic acid is employed as the organic silver salt, the silver salt of the organic acid can be co-precipitated with the organic acid which is used for preparing the silver salt of the organic acid and thereby the organic acid and the silver salt of the organic acid can contact intimately each other. Therefore, space arrangement of molecules of the organic silver salt is good when formed into the organic silver salt layer and results in producing excellent heat-development characteristics.

One or more organic acids may be combined with one or more organic silver salts, and further, when the organic silver salt is a silver salt of an organic acid, these organic acids may be the same or different.

For example, there may be mentioned a system of behenic acid and silver behenate, a system of capric acid and silver behenate, a system of behenic acid.stearic acid and silver behenate, a system of behenic acid.-stearic acid and silver behenate.silver stearate and a system of arachidonic acid and silver behenate.

The ratio of the organic silver salt to the organic acid in the organic silver salt layer may be optionally selected. Usually the amount of the organic silver salt is at least 10 molar %, preferably at least 40 molar %, more preferably at least 60 molar %, but less than 100 molar % based on the sum of moles of the organic silver salt and the organic acid.

Representative organic acids are as shown below.

(a) Fatty acids:

acetic acid, propionic acid, butyric acid, valeric acid, caproic acid, enanthic acid, caprylic acid, pelargonic acid, capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, lacceric acid, acrylic acid, crotonic acid, 5-hexenoic acid, 2-octenoic acid, oleic acid, 4-tetradecenoic acid, 13-docosenoic acid, stearoic acid, behenolic acid, 9-undecynoic acid and the like.

(b) Other organic acids:

arachidonic acid, hydroxystearic acid, benzoic acid, 4-n-octadecyloxydiphenyl-4-carboxylic acid, o-aminobenzoic acid, acetoamidobenzoic acid, p-phenylbenzoic acid, phthalic acid, salicylic acid, oxalic acid, p-nitrobenzoic acid, p-aminobenzoic acid, picolinic acid, quinolinic acid, $\alpha,\alpha'$-dithiodipropionic acid, $\beta,\beta'$-dithiodipropionic acid, thiobenzoic acid, p-toluenesulfonic acid, dodecylbenzenesulfonic acid, taurine, p-toluenesulfinic acid, p-acetoaminobenzenesulfinic acid, diethyldithiocarbamic acid and the like.

Among these organic acids, fatty acids are preferable. A combination of a silver salt of a fatty acid and a fatty acid is particularly preferable.

As the electrically insulating medium for forming the organic silver salt layer, there may be mentioned resinous binders.

It is important that the resinous binder has a film-shapability and is not softened over a certain limit upon heat-development to avoid undue lowering of the binding property. In particular, the latter characteristic is very important because the softening of the binder results in deformation of the images when heat-development is effected with a heating roller. Further, it is preferred that upon heat-development after the formation of latent images by imagewise exposure, the binder does not suppress isolation of silver from the organic silver salt, and positively accelerate the isolation of silver from the organic silver salt at the exposed portions.

Since the electrostatic printing methods which use an electrostatic printing master produced from the heat-developable photosensitive material for electrostatic printing master are based on electrostatic potential contrast between unexposed portions (non-silver image portions) and exposed portions (silver image portions) obtained by charging the surface of the master by corona discharging or the like, it is very important that electrostatic charge is retained as much as possible at the unexposed portions while electrostatic charge is not retained as far as possible at the exposed portions. Therefore, the binder should have a specific resistance capable of retaining electrostatic charge.

In view of the above, there may be used a binder having a specific resistance as high as or higher than a specific resistance of a resin used for a photosensitive member having a photoconductive layer of a CdS-resin dispersion system or a ZnO-resin dispersion system as used usually in electrophotographic technique, though the binder used in the present invention is not limited to such binder. In other words, characteristics necessary for an electrostatic printing master is that there is electrostatic charge retentivity, to some extent, at unexposed portions and in addition, the electrostatic potential contrast between the unexposed portions and the exposed portions is high enough for practical use. For obtaining such electrostatic potential contrast, it is recommendable to select a binder capable of giving an electrostatic printing master in which a specific resistance at unexposed portions of the master is higher than that at the exposed portions by two figures or more or preferably three figures or more.

The specific resistance of the binder is usually $10^{10}$ ohm.cm or more, preferably $10^{11}$ ohm.cm or more, more preferably $10^{13}$ ohm.cm or more.

For the purpose of preventing formation of dielectric breakdown or pinholes at unexposed portions upon charging, it is necessary to select the dielectric breakdown strength of the binder depending upon degree of charging given by corona discharging and the like. The dielectric breakdown strength is usually 10 KV/mm or more, preferably 15 KV/mm or more and more preferably 20 KV/mm or more.

In addition, it is preferable that the binder has a high moisture resistance. When the electrostatic printing master is used in a highly humid atmosphere, lack of moisture resistance results in lowering of the electric resistance at the unexposed portions and thereby lowering of electrostatic potential contrast. Further, electrostatic charge flows to the surface direction of the master. Therefore, moisture resistance of the binder should be appropriately selected depending upon atmospheres and area where the master is used. The moisture resistance is preferably such that the equilibrium moisture content is not more than 3.0%, preferred with not more than 2.0% at a relative humidity of 20–100%.

Representative binders are as shown below:

polyvinyl butyral, polyvinyl acetate, cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinyl methyl ether, styrene-butadiene copolymer, polymethyl methacrylate and the like. These binders may be used alone or in combination.

The amount of the binder in the organic silver salt layer is usually 0.02–20 parts by weight, preferably 0.1–5 parts by weight per one part by weight of the organic silver salt. The above-mentioned polymers as a binder have different chemical and physical properties depending upon the polymer condition so that it is necessary to select such polymers as suitable for the purpose of the present invention. For example, when the binder is polyvinyl butyral, a polyvinyl butyral having averaged degree of polymerization of 500–1000, degree of butyralation of at least 60 molar % and remaining acetyl group of not exceeding 3 molar %, is preferable.

As the solvents for dispersing the organic silver salt in an electrically-insulating resinous binder, there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The organic silver salt layer may be produced by dispersing the organic silver salt in the binder by using a solvent and coating the resulting dispersion on the support. The coating procedure may be carried out by known techniques for producing a thin film from a synthetic resin such as rotating coating methods, air-knife coating methods, wire-bar coating methods, flow-coating methods and the like. The thickness of the layer may be optionally controlled.

To the heat-developable photosensitive material for an electrostatic printing master according to the present invention, there may be added an aggregation accelerator for metallic silver upon heat-developing, a toning agent for control color tone of the resulting image, a stabilizer for images for a long time of storage, a light resistant agent capable of preventing a formation of fog during storing the material before using and preventing deterioration of formed images due to fog after forming the images, a dye sensitizer, a developing accelerator and the like, in an amount necessary for each agent in accordance with the characteristics of the heat-developable photosensitive material.

Among the above mentioned agents, as the aggregation accelerator for metallic silver, there may be used heavy metal compounds. The mechanism of increasing aggregation of metallic silver by heavy metal compounds is not yet clear, but it is considered that the heavy metal facilitates aggregating the metallic silver isolated from the organic silver salt upon heat-development uniformly at a dense state in the volume direction of the organic silver salt layer. Therefore, electric resistance at the exposed portions is effectively so lowered that an electrostatic printing master having excellent electrostatic characteristics is obtained.

Representative heavy metal compounds used in the present invention are shown below:

chlorates, sulfates, thiocyanates, nitrates, oxides, sulfides, acetates and the like or Ir, In, Cd, Au, Co, Sn, Tl, Ti, Fe, Cu, Pb, Ni, Pt, Pd, Bi, Mn, Mo, Ru, Rh, Zn, Pb, Sb, Se, Y, Cr, Ag, Hg, Zr, Nb, and Os.

Further examples thereof are:

metal complex compounds such as $K_3[Fe(C_2O_4)_3]$, $Na[PtCl_4]$, $K_2[PdCl_4]$, $K_2[Cd(CN)_4]$, $K_2[Ni(CN)_4]$, tris-(acetyl acetonato) cobalt, bis(acetyl acetonato) nickel, tris(acetyl acetonato) iron (III) and the like, lead palmitate, zinc salicylate, copper lactate, zinc diethyldithiocarbamate, and copper dithizone.

These heavy metal compounds may be used alone or in combination.

The amount of the heavy metal compound may be optionally selected depending upon each purpose. Usually the amount of the heavy metal is $1\text{-}10^{-7}$ mole, preferably $3\times10^{-1}\text{-}2\times10^{-6}$ moles, and more preferably $5\times10^{-2}\text{-}1\times10^{-5}$ mole per one mole of the organic silver salt.

If desired, a plasticizer may be added to the heat-developable photosensitive material according to the present invention.

Representative plasticizers are dioctyl phthalate, tricresyl phosphate, diphenyl chloride, methyl naphthalene, p-terphenyl, diphenyl and the like.

As mentioned previously, the heat-developable photosensitive material according to the present invention has a support and an organic silver salt layer and if desired, other layer(s) on the support, and the thickness of the total layers on the support is usually 1–50 microns, preferred with 2–30 microns.

The base may be a metal plate such as aluminum, copper, zinc, silver and the like, a metal laminate paper, a paper treated to prevent permeation of a solvent, a paper treated with a conductive polymer, a synthetic resin film containing a surface active agent, a glass paper, synthetic resin, film and the like having on the surface a vapor-deposited metal, metal oxide or metal halide. Further, there may be used an insulating glass, paper, synthetic resin and the like. In particular, a flexible metal sheet, paper or other conductive materials which can be wound on a drum are preferable.

When a coated paper having a terra alba coating on a wood free paper is used as the support, there can be obtained a heat-developable photosensitive material capable of producing an electrostatic printing master having excellent electrostatic and mechanical characteristics. It is considered that this is attributable to the fact that the coating paper allows the coating material to permeate the paper at an appropriate degree upon producing the coating layers such as the organic silver salt layer. As the result, there is formed an electrostatic printing master having a uniform electrostatic potential contrast, a high mechanical strength and an excellent durability.

A coated paper used as the support is preferably a wood free paper having a coating of terra alba. Representative papers are super wood free paper, light weight coat paper, coat paper and art paper. The coated paper has appropriate smoothness and air-permeability. Smoothness is preferably at least 30 sec. (Bekk test-JIS: P8119) and more preferably at least 50 sec. and air-permeability is preferably at least 100 sec. (Gurley-JIS: P 8117), and more preferably at least 200 sec.

As to paper material, an art paper is particularly preferred.

Thickness of the coated paper may be optionally selected depending upon characteristics of the electrostatic printing master and the electrostatic printing process used. Usually the thickness is 10–200 microns, preferred with 20–150 microns.

By using a coated paper as a support, the resulting electrostatic printing master can be advantageously wound around a drum and further the production cost of the master is inexpensive.

The most general electrostatic printing process employing the electrostatic printing master produced from the heat-developable photosensitive material according to the present invention comprises charging, developing and transferring steps. For example, the electrostatic printing master is passed through, for example, under a negative corona electrode and negative charge is given to the surface region of the non-silver image portions of the electrostatic printing master. In this case, a positive corona electrode or alternating current corona electrode may be used in place of the negative corona electrode. As the result, latent images (electrostatic charge patterns) are formed selectively on the non-silver image portions. The electrostatic images may be converted to toner images by known developing method such as cascade, magnet brush, liquid, magnedry, water developments and the like. When toner particles are not charged or charged with an electric charge opposite to imparted to the electrostatic images, the toner particles attach to the electrostatically charged portions. Then, an image receiving member is brought into contact with the surface of the toner images and the toner images can be transferred to the image receiving member by, for example, applying a corona electrode of a polarity opposite to that of the toner particles from the back side of the image receiving member. The toner images thus transferred may be fixed according to known methods. Usually, heat fixation, solvent fixation and the like are used and in case of liquid development, only drying may be necessary.

Further a pressure fixation may be employed. Toner particles remaining on the surface of the electrostatic printing master after transferring may be removed by a cleaning means such as brush, fur-brush, cloth, blade and the like to clean the surface of the master.

Electrostatic printing processes may be effected by a recycle of charging, developing, transferring and cleaning, or a recycle utilizing durability of the electrostatic images of developing, transferring, and cleaning. Cleaning step may be omitted, if desired.

The present invention will be understood more readily by reference to the following examples. However, these examples are intended the invention and are not to be construed to limit the scope of the invention.

EXAMPLE 1

25 g. of 80 mol % silver behenate*1, 120 g. of toluene and 120 g. of methylethylketone were mixed and dispersed by the ball milling method for 72 hours or more. To the mixture, 60 g. of polyvinyl butyral BM-1*2 (20 wt.% ethyl alcohol solution) and 40 g. of ethyl alcohol were then added and sufficiently mixed to prepare a polymer dispersion containing an organic silver salt. To the polymer dispersion, a solution of 120 mg. of mercury acetate in 25 ml of methyl alcohol, a solution of 200 mg. of calcium bromide in 25 ml of methyl alcohol and 2.5 g. of phthalazinone were further added and mixed. The polymer dispersion thus prepared was coated to an art paper at a dark place in the thickness of 8μ after drying by a coating rod to form an organic silver salt layer.

Meanwhile, 1.5 g. of 2,2'-methylene-bis-(6-t-butyl-p-cresol), 0.3 g. of phthalazinone, 10 g. of cellulose acetate L-30*3 (10 wt.% acetone solution) and 30 g. of acetone were mixed to prepare an over-coating layer-forming solution.

The solution thus prepared was coated to the foregoing organic silver salt layer at a dark place in the thickness of 4μ after drying to prepare a heat-developable photosensitive material.

Note: (*1) What is meant by 80 mol% silver behenate is a mixture consisting of 80 mol% of silver behenate and 20 mol% of behenic acid. Therefore, X mol% organic silver salt used in the examples means a mixture consisting of X mol% of organic silver salt and (100-X) mol% of organic acid, and "X mol%" is shown in the formula:

$$\frac{\left(\begin{array}{c}\text{Mol number of}\\ \text{organic silver salt}\end{array}\right)}{\left(\begin{array}{c}\text{Mol number of}\\ \text{organic silver salt}\end{array}\right)+\left(\begin{array}{c}\text{Mol number of}\\ \text{organic acid}\end{array}\right)}\times 100$$

(*2) BM-1: A specific name of trade name, S-Lec B, for a product of Sckisui Chemical Co.; average polymerization 500–1000; butyralation degree 62±3 mol%; remaining acetyl group 3 mol% or below (*3) L-30: A specific name of trade name, L-AC, for a product of DAICEL Ltd.; average polymerization degree 150; acetylation degree 55%

The foregoing heat-developable photosensitive material was exposed to a tungsten light source (2500 lux) for about 20 seconds to form a latent image, and then heating was conducted by using a roller heat developing device at about 130° C. for about 5 seconds to visualize the latent image. The measuring was conducted with respect to the maximum reflection density of the visualized image and the fog density (reflection density when heating the unexposed portion). As the result, the maximum reflection density was 1.8 and the fog density 0.12. It was recognized that the heat-developable photosensitive material gave a clear visible image of a pure black tone and was excellent in the practicality.

EXAMPLE 2

The following organic silver layer-forming composition A-1 and over-coating layer-forming composition B-1 were prepared in accordance with the procedure set forth in Example 1, and the compositions A-1 and B-1 were coated to an art paper in the same manner as in Example 1 to prepare a heat-developable photosensitive material.

| | |
|---|---|
| Composition A-1: | |
| 90 mol % silver behenate | 27 g. |
| Methylethylketone | 120 g. |
| Toluene | 120 g. |
| Polyvinyl butyral BM-1 (10 wt. % ethyl alcohol solution) | 100 g. |
| Mercury acetate | 120 mg. |
| Calcium bromide | 200 mg. |
| Phthalazinone | 2.5 g. |
| Composition B-1: | |
| 2,2'-methylene-bis-(6-t-butyl-p-cresol) | 1.5 g. |
| Cellulose acetate L-30 (10 wt. % acetone solution) | 10 g. |
| Acetone | 30 g. |
| 3,3'-diethyl-2,2'-thiacarbocyanine iodide | 8 mg. |

The heat-developable photosensitive material was subjected to the same exposure and heat development as those in Example 1, but in this case, the exposure time was 3 seconds and the development time 2 seconds. The maximum reflection density ($D_{max}$) of the obtained image was 1.9 and the fog density ($D_{min}$) was 0.24. The value of this fog density was mostly due to the color formed in the unexposed portion by the used coloring matter itself. Therefore, it was recognized that the heat-developable photosensitive material was also excellent in the practicality for use as in the case of Example I.

EXAMPLE 3

The same procedure as that in Example 2 was repeated except that the 90 mol% silver behenate was replaced by the mixtures (1)–(4) described in Table-1 to prepare Samples (1-1)–(1-4). Each sample was measured in the same manner as in Example 2 to obtain the results shown in Table-2. It was confirmed that Samples (1-1)–(1-4) were all excellent heat-developable photosensitive materials as in the case of Example 2.

EXAMPLE 4

The same procedure as that in Example 2 was repeated except that the silver behenate-behenic acid mixture in Composition A-1 was replaced by the mixtures (5) and (6) described in Table-1 and the amount of the 2,2'-methylene-bis-(6-t-butyl-p-cresol) in Composition B-1 was changed to 1 g. so that Samples 2-1 and 2-2 were prepared. Each sample was tested in the same manner as in Example 2 to obtain good results shown in Table-2 as in the case of Example 2. It is confirmed from the results that Samples (2-1) and (2-2) were excellent heat-developable photosensitive materials.

EXAMPLE 5

The same procedure as that in Example 2 was repeated except that the silver behenate-behenic acid mixture in Composition A-1 was replaced by the mixtures (7), (8) and (9) in Table-1 and the amount of 2,2'-methylene-bis-(6-t-butyl-p-cresol) in Composition B-1 was changed to 0.7 g. so that Samples (3-1)–(3-3) were prepared. Each sample was tested in the same manner as in Example 2 to obtain good results, which were shown in Table 2, as in the case of Example 2. It was confirmed from the results that Samples (3-1)–(3-3) were all excellent heat-developable photosensitive materials.

TABLE 1

| Mixture | Organic silver salt |
|---|---|
| 1 | 70 mol % silver behenate |
| 2 | 60 mol % silver behenate |
| 3 | 40 mol % silver behenate |
| 4 | 30 mol % silver behenate |
| 5 | 80 mol % silver stearate |
| 6 | 60 mol % silver stearate |
| 7 | 90 mol % silver laurate |
| 8 | 70 mol % silver laurate |
| 9 | 80 mol % silver caprate |

TABLE-2

| Sample | Compound | $D_{max}$ | $D_{min}$ |
|---|---|---|---|
| 1-1 | 1 | 1.9 | 0.27 |
| 1-2 | 2 | 1.8 | 0.28 |
| 1-3 | 3 | 1.8 | 0.28 |
| 1-4 | 4 | 1.9 | 0.29 |
| 2-1 | 5 | 1.8 | 0.28 |
| 2-2 | 6 | 1.6 | 0.29 |
| 3-1 | 7 | 1.6 | 0.28 |
| 3-2 | 8 | 1.6 | 0.29 |
| 3-3 | 9 | 1.5 | 0.29 |

EXAMPLE 6

The following organic silver layer-forming composition A-2 and over-coating layer-forming composition B-2 was prepared in accordance with the procedure set forth in Example 1, and the compositions A-2 and B-2 were coated to an art paper in the same manner as in Example 1 to prepare a heat-developable photosensitive material.

| | |
|---|---|
| Composition A-2: | |
| 90 mol % silver behenate | 25 g. |
| Methlethylketone | 120 g. |
| Toluene | 120 g. |
| Polyvinyl butyral BM-4* (10 wt. % ethyl alcohol solution) | 100 g. |
| Mercury acetate | 120 mg. |
| Calcium bromide | 200 mg. |
| Phthalazinone | 2.5 g. |
| Composition B-2: | |
| 2,2'-methylene-bis-(6-t-butyl-p-cresol) | 1.5 g. |
| Cellulose acetate L-30 (10 wt. % acetone solution) | 10 g. |
| Acetone | 30 g. |
| 3,3'-diethyl-2,2'-thiocarbocyanine iodide | 8 mg. |

Note
*BM-4: A trade name for a product of Sekisui Chemical Co.; average polymerization degree 500–1000; butyralation degree 62 ± 3 mol %; remaining acetyl group 4–6 mol %

The heat-developable photosensitive material was also subjected to the same exposure and heat development as those in Example 1, but in this case, the exposure time was 3 seconds and the development time 2 seconds. The maximum reflection density ($D_{max}$) of the obtained image was 1.8 and the fog density ($D_{min}$) was 0.22. The value of this fog density was mostly due to the color formed in the unexposed portion by the used coloring matter itself. Therefore, it was confirmed that the heat-developable photosensitive material was also excellent in the practicality for use in the case of Example 1.

EXAMPLE 7

The same procedure as that in Example 6 was repeated except that the binding agent, polyvinyl butyral BM-4 was replaced by the binding agents (10)–(15) described in Table-3 to prepare Samples (4-1)–(4-6). Each sample was measured in the same manner as in Example 2 to obtain the results shown in Table-4. From the results, Samples (4-1)–(4-6) were all recognized to be excellent heat-developable photosensitive materials as in the case of Example 2.

TABLE-3

| No. | Binding agent |
|---|---|
| 10 | BMS** (10 wt. % methylethylketone sol.) |
| 11 | BH-1*** (10 wt. % ethanol : toluene = 1 : 1 by wt. sol.) |
| 12 | Cellulose acetate butyrate (10 wt. % MEK sol.) |
| 13 | L-30 (10 wt. % acetone sol.) |
| 14 | Polyvinyl acetate (10 wt. % acetone sol.) |
| 15 | Polystyrene (5 wt. % toluene sol.) |

Note:
**BMS: Trade name for a product of Sekisui Chemical Co.; average polymerization degree 700–800; butyralation degree 67 mol % or above; remaining acetyl group 4–6 mol %
***BH-1; Trade name for a product of Sekisui Chemical Co.; average polymerization degree 1000–2000; butyralation degree 62 ± 3 mol %; remaining acetyl group 3 mol % or below

TABLE-4

| Sample | Binding agent No. | $D_{max}$ | $D_{min}$ |
|---|---|---|---|
| 4-1 | 10 | 1.8 | 0.27 |
| 4-2 | 11 | 1.7 | 0.27 |
| 4-3 | 12 | 1.7 | 0.26 |
| 4-4 | 13 | 1.6 | 0.28 |
| 4-5 | 14 | 1.7 | 0.30 |
| 4-6 | 15 | 1.6 | 0.28 |

EXAMPLE 8

25 g. of 100 mol% silver behenate, 120 g. of methylethylketone and 120 g. of toluene were mixed and dispersed by the ball milling method for 72 hours or more. To the mixture, 50 g. of polyvinyl butyral BM-1 (20 wt.% dioxane solution) and 20 g. of cellulose acetate (10 wt.% dioxane solution) were further added and mixed to prepare a polymer dispersion containing an organic silver salt. 120 mg. of mercury acetate, 200 mg. of calcium bromide and 2.5 g. of phthalazinone were mixed with the polymer dispersion to prepare an organic silver salt layer-forming solution. This solution was coated to an art paper in the same manner as in Example 1 to form an organic silver salt layer.

On the other hand, a solution of the same composition as Composition B-1 in Example 2 was prepared as an over-coating layer-forming solution and coated to the foregoing organic silver salt layer in the same manner as in Example 1 to prepare a heat-developable photosensitive material.

This photosensitive material was subjected to the same test as in Example 2 to obtain a very excellent result, $D_{max}=1.8$ and $D_{min}=0.26$. The photosensitive material in this example was also recognized to be excellent as in the case of Example 2.

EXAMPLE 9

The following organic silver layer-forming composition A-3 and over-coating layer-forming composition B-3 were prepared in accordance with the procedure set forth in Example 1, and the compositions A-3 -and B-3 were coated to an art paper in the same manner as in Example 1 to prepare a heat-developable photosensitive material.

| | |
|---|---|
| Composition A-3: | |
| 70 mol % silver behenate | 25 g. |
| Methylethylketone | 120 g. |
| Toluene | 120 g. |
| Ethylene-vinyl acetate copolymer (5 wt. % toluene solution) | 150 g. |
| Mercury acetate | 120 mg. |
| Calcium bromide | 200 mg. |
| Phthalazinone | 2.5 g. |
| Composition B-3: | |
| 2,2'-methylene-bis-(6-t-butyl-p-cresol) | 1.5 g. |
| Cellulose acetate L-30 (10 wt. % acetone solution) | 10 g. |
| Acetone | 30 g. |
| 3,3'-diethyl-2,2'-thiacarbocyanine iodide | 8 mg. |

The heat-developable photosensitive material was also subjected to the same exposure and heat development as those in Example 1, but in this case, the exposure time was 3 seconds and the development time 2 seconds. The maximum reflection density ($D_{max}$) of the obtained image was 1.8 and the fog density ($D_{min}$) was 0.26. The value of this fog density was mostly due to the color formed in the unexposed portion by the used coloring matter itself. Therefore, it was confirmed that the heat-developable photosensitive material was also excellent in the practicality for use as in the case of Example 1.

EXAMPLE 10

The same procedure as in Example 9 was repeated except that 90 mol% silver stearate was used in place of 70 mol% silver behenate and the amount of 2,2'-methylene-bis-(6-t-butyl-p-cresol) was changed to 0.8 g. so that an excellent heat-developable photosensitive material was obtained.

EXAMPLE 11

The same procedure as in Example 10 was repeated except that 100 g. of terpene resin (10 wt.% butyl acetate solution) was used in place of ethylene-vinyl acetate copolymer so that an excellent heat-developable photosensitive material was obtained.

EXAMPLE 12

The same procedure as in Example 9 was repeated except that 80 mol% silver laurate was used in place of 70 mol% silver behenate and the amount of 2,2'-methylene-bis-(6-t-butyl-p-cresol) was changed to 0.5 g. so that an excellent heat-developable photosensitive material was obtained.

EXAMPLE 13

The same procedure as in Example 12 was repeated except that the binding agent (12) was used in place of ethylene-vinyl acetate copolymer so that an excellent heat-developable photosensitive material was obtained.

EXAMPLE 14

25 g. of 90 mol% silver behenate, 10 g. of stearic acid, 120 g. of toluene and 120 g. of methylethylketone were mixed and dispersed by the ball milling method for 72 hours or more. To the mixture, 100 g. of polyvinyl butyral BM-1 (10 wt.% ethyl alcohol solution) were further added and mixed to prepare a polymer dispersion containing an organic silver salt. 120 mg. of mercuric acetate, 200 mg. of calcium bromide and 2.5 g. of phthalazinone were added to the polymer dispersion to prepare an organic silver salt layer-forming solution. This solution was coated to an art paper in the same manner as in Example 1 to form an organic silver salt layer, and Composition B-1 in Example 2 was coated to the organic silver salt layer in the same manner as in Example 1 to prepare a heat-developable photosensitive material.

The property of this photosensitive material was measured in the same manner as in Example 2. As the result, the photosensitive material was found to be excellent in the development property and the image quality.

EXAMPLE 15

The same procedure as in Example 14 was repeated except that 80 mol% silver behenate was used in place of 90 mol% silver behenate and lauric acid was used instead of stearic acid so that a good heat-developable photosensitive material was obtained.

EXAMPLE 16

In this example, the mixing ratio between the organic silver salt and the binding agent as shown in Table-5 was investigated. Sample 5-1 was tested in the same manner as in Example 2. Also, Samples 5-2 and 5-3, and Samples 5-4 and 5-5 were tested in the same manner as in Example 1, and Example 4, respectively. From the results of these tests, each sample was observed to be an excellent heat-developable photosensitive material.

TABLE-5

| Sample | Organic silver salt*1 | Binding agent, amount |
|---|---|---|
| 5-1 | 90 mol % silver behenate | BM-1 (20 wt. % EtOH) 100 g. |
| 5-2 | 80 mol % silver behanate | BM-1 (20 wt. % EtOH) 100 g. |
| 5-3 | " | BMS (10 wt. % MEK) 80 g. |
| 5-4 | 80 mol % silver stearate | BM-4 (20 wt. % EtOH) 100 g. |
| 5-5 | " | Terpene resin 200 g. (10 wt. % butyl acetate) |

Note:
*1The amount of the organic silver salt is 25 g. in each case.

Preparation of each sample:

Sample 5-1: The binding agent used in Example 1 is replaced by the binding agent described in Table-5.

Sample 5-2 and Sample 5-3: The binding agent in Example 1 is replaced by the binding agent in Table-5 and 40 g. of ethyl alcohol is removed.

Sample 5-4 and Sample 5-5: The binding agent in Example 4 is replaced by that in Table-5.

In addition, each sample was prepared by the same procedure as in each example except that the organic silver salt and the binding agent were varied.

EXAMPLE 17

The same procedure as in Example 2 was repeated except that cellulose acetate LM-70* and LT-80** were separately used in place of cellulose acetayte L-30 to prepare heat-developable photosensitive material samples 6-1 and 6-2. The samples were tested in the same manner as in Example 2 to obtain good results as in the case of Example 2.

Note: (*) LM-70 (Trade name, DAICEL Ltd.): acetylation degree 53%; average polymerization degree 180; (10 wt.% acetone solution)

(**) LT-80 (Trade name, DAICEL Ltd.): acetylation degree 61%; average polymerization degree 280; (10 wt.% methylene chloride: methanol (9:1) solution)

EXAMPLE 18

It was examined whether or not the heat-developable photosensitive material obtained in Example 1 could be used as an electrostatic printing master.

The photosensitive material was exposed to a tungsten light (2500 lux) through a positive image for 20 seconds and the heat development was then conducted by a roller heating device at 130° C. for 5 seconds to obtain a negative print visible image. This photosensitive material was used as an electrostatic printing master.

Corona discharge at +7 KV was uniformly applied to the electrostatic printing master, and then the toner thus negatively charged was developed by the magnetic brush development to obtain a positive toner image. A transferring paper was placed over the toner image, and the foregoing corona discharge was applied from the transferring paper side to obtain a clear visible image thus transferred. Even when the charging and development transferring were repeated to conduct the transferring 1000 times or more, any deterioration of the master surface was not observed, and also it was not observed that the quality of the transferred image became bad. It was found from the result that the master was an excellent electrostatic printing master for repeat use.

Since the silver image exhibited the reproducibility with faithful with respect to the original image, the electrostatic latent image was correspondingly formed with faithful and the toner image correspondingly became a photographic image with faithful.

The electrostatic characteristics of this electrostatic printing master were measured so that the potential difference (electrostatic potential contrast) between the exposed portion (silver image portion) and the unexposed portion (non-silver image portion) was 380 V and the background potential was very small. The maximum reflection density ($D_{max}$) of the exposed portion in the master was measured and found to be 1.8, and further the fog density of the non-image portion in the transferring paper having the transferred image was measured and found to be a very small value, 0.13.

In view of the foregoing, the heat-developable photosensitive material obtained in Example 1 was confirmed to be very clear in the transferred visible image on the transferring paper and excellent in the image quality free from fog and further to produce an electrostatic printing master which was excellent in the mechanical, electrostatic, repeating durability. Therefore, it was recognized that the heat-developable photosensitive material was a very excellent photosensitive material giving an electrostatic printing master and could be used as a heat-developable photosensitive material for producing an electrostatic printing master.

EXAMPLE 19

The same procedure as that in Example 2 was repeated except that terpene resin (10 wt.% butyl acetate solution) was used in place of polyvinyl butyral in the same amount to prepare a heat-developable photosensitive material. The photosensitive material was examined in the same manner as in Example 18 so that it was found to exhibit an excellent characteristic as a heat-developable photosensitive material for producing an electrostatic printing master.

EXAMPLE 20

It was examined in the same manner as in Example 18 whether or not the heat-developable photosensitive materials obtained in Examples 2–17 could be used as electrostatic printing masters. As the result, it was found that the heat-developable photosensitive materials of Examples 2–17 were all excellent in the image quality and the mechanical, electrostatic, repeating durability and exhibited sufficiently each characteristic required for an electrostatic printing master as in the case of Example 18.

In view of the foregoing, the heat-developable photosensitive materials of Examples 2–17 were all found to exhibit characteristics required for a heat-developable photosensitive material for producing an electrostatic printing master and form an excellent electrostatic printing master of sufficient practicality.

EXAMPLE 21

25 g. of 90 mol% silver behenate, 120 g. of toluene and 120 g. of methylethylketone were mixed and dispersed by the ball milling method for 72 hours or more. To the mixture, 100 g. of polyvinyl butyral (10 wt.% ethyl alcohol solution) was then added and sufficiently mixed to prepare a polymer dispersion containing an organic silver salt. To the polymer dispersion, a solution of 200 mg. of calcium bromide in 25 ml of methyl alcohol, a solution of 100 mg. of zinc acetate in 25 ml of methyl alcohol and 2.5 g. of phthalazinone were further added and mixed. The polymer dispersion thus prepared was coated to an art paper at a dark place in the thickness of 8μ after drying by a coating rod to form an organic silver salt layer.

Meanwhile, 1.5 g. of 2,2'-methylene-bis-(6-t-butyl-p-cresol), 0.3 g. of phthalazinone, 10 g. of cellulose acetate (10 wt.% acetone solution), 30 g. of acetone and 9 mg. of the compound having the following formula:

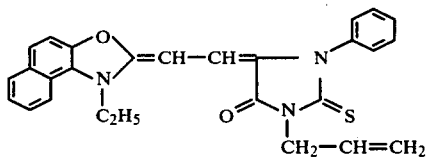

were mixed to prepare an over-coating layer-forming solution.

The solution thus prepared was coated to the foregoing organic silver salt layer at a dark place in the thickness of 4μ after drying to prepare a heat-developable photosensitive material for producing an electrostatic printing master.

This photosensitive material was exposed to a tungsten light source (2500 lux) through a positive image for 3 seconds, and then the heat development was conducted by a roller heating device at 130° C. for 2 seconds to obtain a negative print visible image. This photosensitive material was used as an electrostatic printing master.

Corona discharge at +7 KV was uniformly applied to the electrostatic printing master, and then the toner thus negative charged was developed by the magnetic brush development to obtain a positive toner image.

A transferring paper was placed over the toner image, and the foregoing corona discharge was applied from the transferring paper side to obtain a clear visible image thus transferred.

Even when the charging and development transferring were repeated to conduct the transferring 1000 times or more, any deterioration of the master surface was not observed, and also it was not observed that the quality of the transferred image became bad after the use for a long time. It was found from the result that the master was very excellent for repeated printing.

Since the silver image exhibited the reproducibility with faithful with respect to the original image, the electrostatic latent image was correspondingly formed with faithful and the toner image correspondingly became a photographic image with faithful.

The electrostatic characteristics of this electrostatic printing master were measured so that the potential difference (electrostatic potential contrast) between the exposed portion (silver image portion) and the unexposed portion (non-silver image portion) was 430 V and the background potential was very small. The maximum reflection density ($D_{max}$) of the exposed portion in the master was measured and found to be 1.7, and further the fog density of the non-image portion in the transferring paper having the transferred image was measured and found to be a very small value, 0.12. From these results, the heat-developable photosensitive material for producing an electrostatic printing master obtained in this example was confirmed to be excellent in the image quality and produce an excellent electrostatic printing master having good practicality and mechanical, electrostatic, repeating durability.

EXAMPLE 22

The same procedure as that in Example 21 was repeated except that the compounds (1)–(24) described in Table-6 were separately used in place of zinc acetate in the respective amounts shown in the same table to prepare photosensitive materials (Samples (6-1)–(6-24)) for producing electrostatic printing masters.

These photosensitive materials (Samples (6-1)–(6-24)) were treated in the same manner as in Example 21 to produce electrostatic printing masters and then they were subjected to the same process as in Example 21 to obtain transferred visible images on transferring papers so that in all cases, good results were obtained as in the case of such example. Further, the characteristics required for the master were measured with respect to the photosensitive materials so that good results as shown in Table-7 were obtained.

TABLE-6

| Compound No. | Compound | Amount* (mg.) |
|---|---|---|
| 1 | Bismuth nitrate | 100*1 |
| 2 | Indium nitrate | 200 |
| 3 | Indium iodate | 200 |
| 4 | Cadmium acetate | 150 |
| 5 | Cadmium chlorate | 100 |
| 6 | Cadmium nitrate | 200 |
| 7 | Copper acetate | 150 |

TABLE-6-continued

| Compound No. | Compound | Amount* (mg.) |
|---|---|---|
| 8 | Copper lactate | 250 |
| 9 | Copper nitrate | 200 |
| 10 | Copper salicylate | 250 |
| 11 | Ferric nitrate | 200 |
| 12 | Cobalt acetate | 150 |
| 13 | Cobalt nitrate | 200 |
| 14 | Lead nitrate | 100 |
| 15 | Mercury iodobromide | 100 |
| 16 | Nickel acetate | 150 |
| 17 | Platinum chloride | 250 |
| 18 | Gold chloride | 250 |
| 19 | Zinc salicylate | 250 |
| 20 | Zinc nitrate | 100 |
| 21 | Complex of Cobalt (III)*2 | 200 |
| 22 | Complex of Nickel (II)*3 | 200 |
| 23 | Complex of Iron (III)*4 | 200 |
| 24 | Nickel nitrate | 200 |

Note:
*Compounds 2–20 and 24 are all dissolved in 25 ml of ethyl alcohol.
*1 25 ml acetone solution
*2 Tris(acetylacetonato) cobalt (III)
*3 Bis(acetylacetonato) nickel (II)
*4 Tris(acetylacetonato) Iron (III)

TABLE-7

| Sample | Compound | $D_{max}$* | Fog density** | Electrostatic potential contrast |
|---|---|---|---|---|
| 6-1 | 1 | 1.5 | 0.14 | 420 |
| 6-2 | 2 | 1.6 | 0.12 | 420 |
| 6-3 | 3 | 1.6 | 0.13 | 430 |
| 6-4 | 4 | 1.8 | 0.11 | 450 |
| 6-5 | 5 | 1.5 | 0.12 | 420 |
| 6-6 | 6 | 1.8 | 0.11 | 410 |
| 6-7 | 7 | 1.7 | 0.13 | 450 |
| 6-8 | 8 | 1.5 | 0.13 | 450 |
| 6-9 | 9 | 1.8 | 0.11 | 440 |
| 6-10 | 10 | 1.8 | 0.12 | 450 |
| 6-11 | 11 | 1.7 | 0.12 | 420 |
| 6-12 | 12 | 1.6 | 0.11 | 410 |
| 6-13 | 13 | 1.6 | 0.13 | 420 |
| 6-14 | 14 | 1.8 | 0.11 | 430 |
| 6-15 | 15 | 1.5 | 0.12 | 420 |
| 6-16 | 16 | 1.6 | 0.13 | 420 |
| 6-17 | 17 | 1.6 | 0.14 | 410 |
| 6-18 | 18 | 1.6 | 0.11 | 450 |
| 6-19 | 19 | 1.8 | 0.12 | 430 |
| 6-20 | 20 | 1.7 | 0.13 | 430 |
| 6-21 | 22 | 1.7 | 0.11 | 400 |
| 6-22 | 23 | 1.6 | 0.12 | 400 |
| 6-23 | 24 | 1.7 | 0.12 | 410 |
| 6-24 | 25 | 1.8 | 0.11 | 460 |

Note:
*$D_{max}$: Maximum reflection density
**Fog density in transferring paper

EXAMPLE 23

The same procedure as that in Example 21 was repeated except that 70 mol% silver behenate was used in place of 90 mol% silver behenate to prepare a heat-developable photosensitive material for producing an electrostatic printing master. This photosensitive material was tested in the same manner as in Example 21 to obtain a good result as in the case of Example 21.

EXAMPLE 24

The same procedure as that in Example 21 was repeated except that 80 mol% silver stearate was used in place of 90 mol% silver behenate in the same amount and the amount of 2,2'-methylene-bis-(6-t-butyl-p-cresol) was changed to 1.0 g. so that a heat-developable photosensitive material for producing an electrostatic printing master was prepared. This photosensitive material was tested in the same manner as in Example 21. As the result, it was found that the photosensitive material exhibited excellent characteristics required for an electrostatic printing master as in the case of Example 21.

EXAMPLE 25

The following organic silver salt layer-forming composition A-4 and over-coating layer-forming composition B-4 were prepared in accordance with the procedure of Example 21. These compositions were coated to an art paper to prepare a heat-developable photosensitive material for producing an electrostatic printing master.

| | |
|---|---|
| Composition A-4: | |
| 80 mol % silver caprate | 10 g. |
| Methylethylketone | 30 g. |
| Toluene | 30 g. |
| Polyvinyl butyral (10 wt. % ethyl alcohol solution) | 60 g. |
| $CaBr_2$ | 60 mg. |
| N-bromoacetamide | 50 mg. |
| 2,3-dihydroxy-5-hydroxy-1,4-phthalazine dion | 1 g. |
| Compound (11) in Table-6 | 200 mg. |
| Composition B-4: | |
| 2,2'methylene-bis-(6-t-butyl-p-cresol) | 0.8 g. |
| Cellulose acetate (10 wt. % acetone solution) | 10 g. |
| Acetone | 30 g. |
| 3,3'-diethyl-2,2'-thiacarbocyanine iodide | 8 mg. |

The above-mentioned photosensitive material was also tested with respect to the characteristics required for an electrostatic printing master in the same manner as in Example 21. As the result, it was found to be a heat-developable photosensitive material giving an excellent electrostatic printing master.

EXAMPLE 26

The same procedure as that in Example 21 was repeated except that 90 mol% silver laurate was used in place of 90 mol% silver behenate and the amount of 2,2'-methylene-bis-(6-t-butyl-p-cresol) was changed to 0.8 g. so that a heat-developable photosensitive material for producing an electrostatic printing master was prepared. This photosensitive material was tested in the same manner as in Example 21. As the result, it was found to be a photosensitive material sufficiently exhibiting characteristics required for an electrostatic printing master.

EXAMPLE 27

In 200 ml of tricresyl phosphate, 6.8 g. of behenic acid was dissolved at 70° C. 0.3 g. of compound (21) described in Table-6 was dissolved in 100 ml of methylethylketone and this solution was mixed with the former solution at 70° C. while they were sufficiently stirred.

While the mixed solution was stirred at 70° C., a solution which was prepared by adding aqueous ammonia to about 80 ml of aqueous solution containing 3.0 g. of silver nitrate to adjust the total amount to 100 ml was added dropwise to the mixed solution for 10 minutes. After the total amount was added dropwise, the reaction liquid was allowed to stand at a room temperature for one hour so that the water phase and tricresyl phosphate phase were separated. The water phase was first removed, and the tricresyl phosphate phase was washed with about 100 ml of water to obtain 6.0 g. of silver behenate. 25 g. of the thus obtained silver behenate was used to prepare a heat-developable photosensitive material for producing an electrostatic printing master in the same manner as in Example 21. It was examined whether the photosensitive material could be used as an electrostatic printing master or not. As the result, it was found to be a photosensitive material giving an excellent electrostatic printing master as in the case of Example 21.

EXAMPLE 28

The same procedure as that in Example 27 was repeated except that toluene was used in place of tricresyl phosphate in the same amount and compound (22) described in Table-6 was used in place of compound (21) in the same amount to obtain 6.2 g. of silver behenate. The thus obtained silver behenate was used to prepare a heat-developable photosensitive material for producing an electrostatic printing master in the same manner as in Example 27. The heat-developable photosensitive material was tested with respect to the characteristics required for an electrostatic printing master in the same manner as in Example 27, and as the result, it was confirmed to be a photosensitive material giving an excellent electrostatic printing master as in the case of Example 27.

EXAMPLE 29

The same procedure as in Example 27 was repeated except that compound (23) described in Table-6 was used in place of compound (21) in the same amount to prepare silver behenate. The thus prepared silver behenate was used to conduct the same procedure as in Example 27 so that a heat-developable photosensitive material was obtained which gave an excellent electrostatic printing master.

EXAMPLE 30

The same procedure as in Example 21 was repeated except that a solution of 100 mg. of mercuric nitrate in 25 ml methyl alcohol was further added to the organic silver salt layer-forming solution to prepare a heat-developable photosensitive material for producing an electrostatic printing master. The heat-developable photosensitive material was tested with respect to the characteristics required for an electrostatic printing master so that a good result was obtained.

EXAMPLE 31

The same procedure as in Example 21 was repeated except that compounds (9) and (2) described in Table-6 were added to the organic silver salt layer-forming solution in place of zinc acetate so that an excellent heat-developable photosensitive material for producing an electrostatic printing master was obtained.

EXAMPLE 32

25 g. of 90 mol% silver behenate, 120 g. of toluene and 120 g. of methylethylketone were mixed and dispersed by the ball milling method for 72 hours or more. To the mixture, 100 g. of polyvinyl butyral (20 wt.% ethyl alcohol solution) was then added and sufficiently mixed to prepare a polymer dispersion containing an organic silver salt. To the polymer dispersion, a solution of 120 mg. of mercury acetate in 25 ml of methyl alcohol, a solution of 150 mg. of ammonium bromide in 25 ml methyl alcohol, and 2.5 g. of phthalazinone were further added and mixed. The polymer dispersion thus prepared was coated to an art paper at a dark place in the thickness of 8μ after drying by a coating rod to form an organic silver salt layer.

Meanwhile, 1.5 g. of 2,2'-methylene-bis-(6-t-butyl-p-cresol), 0.3 g. of phthalazinone, 10 g. of cellulose acetate (10 wt.% acetone solution) and 30 g. of acetone were mixed to prepare an over-coating layer-forming solution.

The solution thus prepared was coated to the foregoing organic silver salt layer at a dark place in the thickness of 4μ after drying to prepare a heat-developable photosensitive material for producing an electrostatic printing master.

The photosensitive material was exposed to a tungsten light (2500 lux) through a positive image for 20 seconds and the heat development was then conducted by a roller heating device at 130° C. for 5 seconds to obtain a negative print visible image. This photosensitive material was used as an electrostatic printing master. Corona discharge at +7 KV was uniformly applied to the electrostatic printing master, and then the toner thus negatively charged was developed by the magnetic brush development to obtain a positive toner image. A transferring paper was placed over the toner image, and the foregoing corona discharge was applied from the transferring paper side to obtain a clear visible image thus transferred. Even when the charging and development transferring were repeated to conduct the transferring 1000 times or more, any deterioration of the master surface was not observed, and also it was not observed that the quality of the transferred image became bad. As the result, it was found that the master was an excellent electrostatic printing master for repeat use.

Since the silver image exhibited the reproducibility with faithful with respect to the original image, the electrostatic latent image was correspondingly formed with faithful and the toner image correspondingly became a photographic image with faithful.

The electrostatic characteristics of this electrostatic printing master were measured so that the potential difference (electrostatic potential contrast) between the exposed portion (silver image portion) and the unexposed portion (non-silver image portion) was 450 V and the background potential was very small. The maximum reflection density ($D_{max}$) of the exposed portion in the master was measured and found to be 1.8, and further the fog density of the non-image portion in the transferring paper having the transferred image was measured and found to be a very small value, 0.12. From these results, the heat-developable photosensitive material for producing an electrostatic printing master obtained in this example was confirmed to be excellent in the image quality and produce an excellent electrostatic printing master having good practicality and mechanical, electrostatic, repeating durability.

EXAMPLE 33

The same procedure as that in Example 32 was repeated except that halides, compounds (1)–(17) described in Table-8 were separately added to the organic silver salt layer-forming composition in the respective amounts shown in the table in place of ammonium bromide to prepare heat-developable photosensitive materials [samples (7-1)–(7-17)] for producing electrostatic printing masters.

These photosensitive materials [samples (7-1)–(7-17)] were treated in the same manner as in Example 32 to prepare electrostatic printing masters. It was tested in the same manner as in Example 32 whether these masters could be used practically as desired printing masters or not. As the result, it was found that the transferred images were very clear and the masters were excellent in the mechanical, electrostatic, repeating durability. Further, it was found that these masters were not at all inferior to those of Example 32 in the electrostatic characteristics as shown in Table-9. Therefore, it became clear that samples (7-1)–(7-17), the heat-developable photosensitive materials for producing electrostatic printing masters were able to produce very excellent electrostatic printing masters.

TABLE-8

| Compound No. | Compound | Amount (mg.) |
|---|---|---|
| 1 | Sodium chloride | 250 |
| 2 | Potassium chloride | 250 |
| 3 | Rubidium chloride | 280 |
| 4 | Cesium chloride | 280 |
| 5 | Ammonium chloride | 250 |
| 6 | Lithium chloride | 250 |
| 7 | Potassium bromide | 280 |
| 8 | Sodium bromide | 280 |
| 9 | Lithium bromide | 280 |
| 10 | Rubidium bromide | 300 |
| 11 | Cesium bromide | 300 |
| 12 | Sodium iodide | 300 |
| 13 | Potassium iodide | 300 |
| 14 | Lithium iodide | 300 |
| 15 | Ammonium iodide | 300 |
| 16 | Rubidium iodide | 320 |
| 17 | Cesium iodide | 320 |

TABLE-9

| Sample | Compound | $D_{max}$* | Fog density** | Electrostatic potential contrast |
|---|---|---|---|---|
| 7-1 | 1 | 1.8 | 0.11 | 420 |
| 7-2 | 2 | 1.7 | 0.12 | 430 |
| 7-3 | 3 | 1.7 | 0.11 | 420 |
| 7-4 | 4 | 1.6 | 0.12 | 450 |
| 7-5 | 5 | 1.8 | 0.12 | 430 |
| 7-6 | 6 | 1.7 | 0.12 | 440 |
| 7-7 | 7 | 1.7 | 0.11 | 450 |
| 7-8 | 8 | 1.8 | 0.11 | 460 |
| 7-9 | 9 | 1.9 | 0.11 | 450 |
| 7-10 | 10 | 1.8 | 0.11 | 460 |
| 7-11 | 11 | 1.6 | 0.11 | 450 |
| 7-12 | 12 | 1.6 | 0.12 | 430 |
| 7-13 | 13 | 1.8 | 0.13 | 420 |
| 7-14 | 14 | 1.7 | 0.11 | 410 |
| 7-15 | 15 | 1.7 | 0.12 | 450 |
| 7-16 | 16 | 1.8 | 0.11 | 440 |
| 7-17 | 17 | 1.6 | 0.12 | 420 |

Note:
*$D_{max}$: Maximum reflection density.
**Fog density in transferring paper

EXAMPLE 34

The same procedure as in Example 32 was repeated. However, 70 mol% silver behenate was used in place of 90 mol% silver behenate used in Example 32 and compounds (18)–(22) described in Table-10 were added in place of ammonium bromide in the respective amounts to the organic silver salt layer-forming composition. Further, 8 mg. of the compound of the following formula:

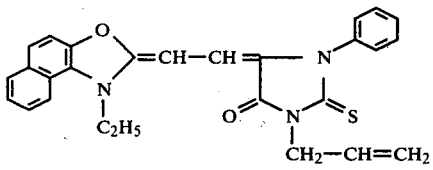

was added to the over-coating layer-forming solution. The procedure other than the foregoing was the same as in Example 32. The heat-developable photosensitive materials [samples (8-1)–(8-5)] for producing electrostatic printing masters were prepared in the same manner as in Example 32.

These photosensitive materials [samples (8-1)–(8-5)] were subjected to the exposure for 3 seconds and heat development for 3 seconds in the same manner as in Example 32 to prepare electrostatic printing masters. These printing masters were tested in the same manner as in Example 32. As the result, the transferred images were very clear and those masters were found to be excellent in the mechanical, electrostatic, repeating durability as in the case of Example 32. Further, those masters were not at all inferior to those of Example 32 in terms of the electrostatic characteristics as shown in Table-11. Therefore, it became apparent that samples (8-1)–(8-5), heat-developable photosensitive materials for producing electrostatic printing masters were able to produce very excellent electrostatic printing masters.

TABLE-10

| Compound | Preparation of Compound | |
|---|---|---|
| 18 | Compound (1) 100 mg., Compound (9) | 200 mg. |
| 19 | Compound (5) 50 mg., Compound (10) | 250 mg. |
| 20 | Compound (13) 70 mg., Compound (8) | 280 mg. |
| 21 | Compound (16) 100 mg., Ammonium bromide | 250 mg. |
| 22 | Compound (3) 200 mg., Compond (15) | 200 mg. |

TABLE-11

| Sample | Compound | $D_{max}$ | Fog density | Electrostatic potential contrast |
|---|---|---|---|---|
| 8-1 | 18 | 1.9 | 0.11 | 450 (v) |
| 8-2 | 19 | 1.8 | 0.11 | 460 |
| 8-3 | 20 | 1.9 | 0.11 | 480 |
| 8-4 | 21 | 1.8 | 0.11 | 470 |
| 8-5 | 22 | 1.8 | 0.12 | 440 |

EXAMPLE 35

25 g. of 90 mol% silver stearate, 120 g. of toluene and 120 g. of methylethylketone were mixed and dispersed by the ball milling method for 72 hours or more. To the mixture, 100 g. of polyvinyl butyral (10 wt.% ethyl alcohol solution) was then added and sufficiently mixed to prepare a polymer dispersion containing an organic silver salt. To the polymer dispersion, 150 mg. of mercury acetate, 300 mg. of compound (10) and 2.5 g. of phthalazinone were further added and mixed. Furthermore, to this polymer dispersion, 4 g. of 2,2'-methylene-bis-(6-t-butyl-p-cresol) and 60 mg. of 3,3'-diethyl-2,2'-thiacarbocyanine iodide were added and mixed. The polymer dispersion thus prepared was coated to an art paper at a dark place in the thickness of 8μ after drying by a coating rod to form an organic silver salt layer.

To the organic silver salt layer, cellulose acetate solution (5 wt.% acetone solution) was coated at a dark place by a coating rod in the thickness of 2μ after drying to prepare a heat-developable photosensitive material for producing an electrostatic printing master.

This photosensitive material was then subjected to the exposure for 3 seconds and heat development for 2 seconds to prepare an electrostatic printing master, and the same test as in Example 32 was conducted to find out whether this electrostatic printing master exhibited the characteristics desired for the purpose. As the result, the transferred image was very clear and the master was excellent in the mechanical, electrostatic, repeating durability as in the case of Example 32. The electrostatic printing master was also excellent in the electrostatic characteristics as in the case of Example 32. Therefore, it was recognized that the heat-developable photosensitive material produced a very excellent electrostatic printing master.

EXAMPLE 36

The same procedure as that in Example 32 was repeated except that 90 mol% silver laurate was used in place of 90 mol% silver behenate to prepare a heat-developable photosensitive material for producing an electrostatic printing master. It was recognized that the photosensitive material was that capable of producing an excellent electrostatic printing master.

EXAMPLE 37

20 g. of silver behenate, 150 g. of methylethylketone and 150 g. of toluene were mixed and pulverized by a ball mill for 72 hours to prepare a uniform slurry. 100 g. of 20% ethyl alcohol solution of polyvinyl butyral resin was added to the slurry and gently mixed for about 3 hours. Further, 0.12 g. of mercury acetate, 0.2 g. of calcium bromide and 0.5 g. of phthalazinone were added to prepare an organic silver salt layer-forming composition. This composition was uniformly coated to an art paper (trade name: NK art, supplied by Nippon Kako Seishi K.K., A size—57.5 kg.) in a dark place in the thickness of 15μ by a coating rod and dried at 80° C. for 3 minutes to form an organic silver salt layer.

An over-coating layer-forming composition of the following components was prepared and coated to the foregoing organic silver salt layer in the thickness of 3μ to form an overlying layer.

| | |
|---|---|
| 2,2'-methylene-bis-6-t-butyl-p-cresol | 1.5 g. |
| Phthalazinone | 0.3 g. |
| Cellulose acetate (10 wt. % acetone solution) | 10 g. |
| Acetone | 30 g. |
| 3,3'-diethyl-2,2'-thiacarbocyanine iodide | 0.005 g. |

The photosensitive material thus prepared was exposed to a tungsten light source (2500 lux) through a positive image for 12 seconds, and thereafter heat development was conducted by a roller heating device at 130° C. for 2 seconds to obtain a negative print visible image.

After corona discharge of +7 KV was uniformly given to the foregoing photosensitive material, the negatively charged toner was developed by the magnetic brush developing method and the transferring was conducted while corona charge was given from the transferring paper side, to obtain a visible image on the transferring paper. This transferred image was fixed by a heater at 130° C.

In place of the art paper, an uncoated printing paper having the same thickness was used for comparison to prepare a photosensitive material in the same manner as above. The photosensitive material using an art paper and that using an uncoated paper were used as an electrostatic printing master to test the resolution power. As the result, the resolution power of the former was 12 lines/mm while that of the latter was 5.5 lines/mm.

Further, the former master was remarkably excellent in the sharpness of the transferred image. The cross sections of both masters were observed by a microscope. As the result, it was found that in the former master, the organic silver salt layer permeated into the art paper at about 10μ from the interface between the organic silver salt layer and the art paper to form a uniform layer. However, in the latter master, the organic silver salt layer permeated ununiformly into the uncoated paper and therefore a clear boundary was not found out.

EXAMPLE 38

The organic silver salt layer-forming composition shown in Example 37 was coated onto (1) Art paper (trade name: KS one side coated art paper, supplied by Kanzaki K.K., A size—46.5 kg.) (2) Aluminum plate having the thickness of 100μ under the same condition as in Example 37. The exposure and heat development were conducted in the same manner as in Example 37 to prepare electrostatic printing masters.

The master using the art paper and that using the aluminum plate were tested with respect to the adhesion property of these supports by using a cellophane adhesive tape. As the result, the former master was not damaged while in the latter master, a part of the layer was peeled off.

Further, after both masters were prepared, the wet heat accelerated aging was conducted in which both masters were allowed to stand at 35° C. and 90% RH for 72 hours. As the result, in the former master, particularly large change was not observed while in the latter master, the electrostatic potential contrast was somewhat lowered, which is shown in the following table. However, it is recognized that both masters are of sufficient practicability.

| | Electrostatic potential contrast | |
|---|---|---|
| | When master is prepared | After wet, heat accelerated aging |
| Art paper base | 500 v | 480 v |
| Aluminum plate base | 350 v | 270 v |

Note:
Electrostatic potential contrast is that obtained in such a manner that charging of −7 KV is applied to the silver image portion and non-silver image portion of the master for 5 seconds and the surface potential is then measured after 25 seconds since the charging.

EXAMPLE 39

When the organic silver salt layer-forming composition was coated, the following coated papers were used as supports.

| Kind of paper | Standard | Electro-* static potential contrast | Resolution** of transferred image |
|---|---|---|---|
| Art | NK one side coated art paper (trade name, supplied by Nippon Kakoshi K.K.) A size - 57.5 kg | 520 (v) | 11–14 lines/mm |
| Coat | New-Age (trade name, supplied by Kanzaki Seishi K.K.) A size - 57.5 kg | 490 | 12–13 |
| Art | Loston-Color (trade name, supplied by Kanzaki Seishi K.K.) Kiku size (636mm × 939mm) | 500 | 9–10 |
| Coat | Miller-Kote Gold (trade name, supplied by Kanzaki Seishi K.K.) 46 size 73 kg | 470 | 10–12 |
| Conduction treated art | *** | 600 | 12–15 |
| Comparison | Wood free paper A size 46.5 kg | 380 | 5–6 |

Note:
*Value after 3 seconds since charging of +6 KV is applied for 5 seconds. Other procedure is the same as in Example 38.
**In accordance with Example 37.
***Prepared in such a manner that OLIGO ZM-1010 (trade name, supplied by Tomoegawa Seishijo K.K., 10% methanol solution) is coated to non-art surface of NK one side coated art paper A-57.5 kg in the thickness of 2 μ and an organic silver salt layer is imparted to the art surface.

In addition, the above mentioned art and coat paper were 50 seconds or more in the smoothness (Bekk method-JIS P 8119) and 150 seconds or more in the air permeability (Gurley method-JIS P 8117).

Comparison experiments between a commercially available sheet material of U.S. Pat. No. 3,457,075 and the heat-developable photosensitive material was made to compare the characteristics as an electrostatic printing master and it was found that electrostatic potential contrast obtained by the sheet materials of U.S. Pat. No. 3,457,075 was far lower than that obtained by the present invention and thereby failed to give transferred images of a good quality on a receiving paper.

We claim:

1. In a process for electrostatic printing comprising the steps of:

(i) imagewise exposing a supported heat developable photosensitive member having a layer formed by dispersing uniformly an organic silver salt compound in an insulating medium, to form a latent silver image;

(ii) heating with or after said imagewise exposure to develop said latent image and form a conductive metallic silver grain image;

(iii) employing said supported developed member as a master by forming an electrostatic latent image thereon;

(iv) developing said latent image and, (v) transferring the developed image to a transfer material, the improvement comprising; employing a heat-developable photosensitive member for producing an electrostatic printing master having improved electrostatic characteristics comprises a support, (a) an organic silver salt, (b) an organic acid, (c) a halide, (d) a reducing agent, and (e) a binder, having an equilibrium moisture content of not more than 3% at a relative humidity ranging from 20 to 100% at least the organic silver salt (a) and the organic acid (b) being dispersed in the binder (e), the amount of the organic silver salt (a) being at least 10 molar percent based on the sum of the organic silver salt (a) and the organic acid (b), and the amount of the binder (e) being 0.02–20 parts by weight based on one part of the organic silver salt (a).

2. In a process for electrostatic printing comprising the steps of:

(i) imagewise exposing a supported heat developable photosensitive member having a layer formed by dispersing uniformly an organic silver salt compound in an insulating medium, to form a latent silver image;

(ii) heating with or after said imagewise exposure to develop said latent image and form a conductive metallic silver grain image;

(iii) employing said supported developed member as a master by forming an electrostatic latent image thereon;

(iv) developing said latent image and, (v) transferring the developed image to a transfer material, the improvement comprising; employing a heat-developable photosensitive member for an electrostatic printing master which comprises a support, (a) an organic silver salt, (b) an organic acid, (c) a halide, (d) a reducing agent, (e) a binder of a dielectric breakdown strength of at least 10 KV/mm and an equilibrium moisture content of not more than 3% at a relative humidity ranging from 20 to 100%, and (f) a heavy metal compound, and the organic silver salt (a) being dispersed in the binder (e) of 0.02–20 parts by weight per one part by weight of the organic silver salt (a).

* * * * *